US007064259B1

(12) United States Patent
Kelly

(10) Patent No.: US 7,064,259 B1
(45) Date of Patent: Jun. 20, 2006

(54) ELECTRONIC GUITAR TRAINING DEVICE

(76) Inventor: Keith E. Kelly, 334 East Ave. R 12, Palmdale, CA (US) 93550

( * ) Notice: Subject to any disclaimer, the term of this patent is extended or adjusted under 35 U.S.C. 154(b) by 0 days.

(21) Appl. No.: 11/109,768

(22) Filed: Apr. 20, 2005

(51) Int. Cl.
*G10H 1/00* (2006.01)
*A63J 5/00* (2006.01)
*A63J 17/00* (2006.01)

(52) U.S. Cl. ..... 84/464 A; 84/477 R

(58) Field of Classification Search ..... 84/464 A, 84/464 R, 470 R, 477 R
See application file for complete search history.

(56) References Cited

U.S. PATENT DOCUMENTS 3,854,370 A 12/1974 Sapinski
4,286,495 A 9/1981 Roof
4,791,848 A * 12/1988 Blum, Jr. ..... 84/453
4,807,509 A * 2/1989 Graham ..... 84/314 R
5,373,768 A * 12/1994 Sciortino ..... 84/293
5,408,914 A 4/1995 Breitweiser, Jr.
5,796,025 A 8/1998 Haake
D410,671 S 6/1999 Aleksa
6,225,544 B1 5/2001 Sciortino
6,452,081 B1 * 9/2002 Ravagni et al. ..... 84/477 R
2002/0029681 A1 3/2002 Manning

* cited by examiner

*Primary Examiner*—Jeffrey W Donels

(57) ABSTRACT

A training device includes a tubular sleeve mounted to the guitar neck. The sleeve extends along a longitudinal length of the guitar neck and has an open and a closed end portion. A plurality of light-emitting diodes are connected in series and nested within the sleeve. The light-emitting diodes extend along a length of the sleeve and are selectively illuminable. Each light-emitting diode displays one of a red color or a green color, wherein same interchangeably displays the red and green colors. A mechanism is included for automatically illuminating the light-emitting diodes in a sequence corresponding with a desired one of the chords, scales and riffs. The illuminating mechanism is coupled to the light-emitting diodes, mounted to the guitar, and includes a control switch that extends outwardly from the housing. A transformer is mateable to the illuminating mechanism for converting a 110-volt power supply to a 4.5-volt power supply.

9 Claims, 5 Drawing Sheets

ELECTRONIC GUITAR TRAINING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to guitar training devices and, more particularly, to an electronic guitar training device for assisting a novice guitar player to quickly and readily identify the finger positions on a six-string guitar neck which are associated with selected chords, scales and riffs.

2. Prior Art

In the past, it has been the conventional practice for a student learning to play a stringed instrument, such as a guitar for example, to visually place his fingers at precise fret and string locations on the instrument corresponding to a printed chord diagram displayed in an instruction book or sheet music. The diagram generally includes a finger location pattern of two, three or four fingers intended to be duplicated on the instrument by depressing particular strings so as to musically shorten or lengthen the strings.

Actual practice of this teaching or learning method is awkward and cumbersome due to the fact that the student first looks at the diagram in the instruction book and then turns his head to look at the fret board. This tendency also causes the student to twist or turn the instrument to an unnatural position so he can see the fret board and the appropriate location of the finger pattern. Such a procedure produces undesirable habits which require further training. Furthermore, this conventional procedure requires the student to carry the finger location pattern in his mind while his eye leaves the instruction book or music sheet and focuses on the fret board and his finger placement. Usually, several glances back and forth are performed before the student has achieved the correct finger pattern.

Another common procedure resides in the practice of grasping the fingers of the student with those of the instructors or teacher's fingers and manually placing the student's fingers on the proper strings. This procedure is time consuming and awkward. Attempts have been made to employ self-help teaching aids such as perforated masks and specially contoured forms. Difficulties have been encountered which stem largely from the fact that the masks or forms slip from place and distract or erroneously indicate a finger pattern. Also, changes in the pattern cannot be made rapidly or with precision.

Accordingly, a need remains for an electronic guitar training device in order to overcome the above-noted shortcomings. The present invention satisfies such a need by providing a guitar training device that is convenient and easy to use, has educational value, and is durable in design. Such an electronic guitar training device helps a beginning (and intermediate) guitar player to learn proper finger placement by allowing a player to see where to position their fingers on the guitar's neck when forming a chord or creating a scale. The device thus enables a person to learn how to play the instrument at their own pace and without the assistance of a costly private instructor/teacher. The electronic guitar training device advantageously eliminates the need for the player to look at a book or chart and then look back to the instruments neck. This allows for more consistent and continual practices.

BRIEF SUMMARY OF THE INVENTION

In view of the foregoing background, it is therefore an object of the present invention to provide an electronic guitar training device. These and other objects, features, and advantages of the invention are provided by a training device for assisting a novice guitar player to quickly and readily identify the finger positions on a six-string guitar neck which are associated with selected chords, scales, and riffs.

The training device includes an elongated and tubular sleeve formed from transparent material that is removably mounted to the guitar neck in such a manner that the player can effectively maintain a continuous line of sight with the sleeve and the guitar neck during playing conditions. Such a sleeve extends along an entire longitudinal length of the guitar neck. The sleeve is rectilinear, has an open end portion, and an axially offset closed end portion.

A plurality of light-emitting diodes are connected in series and nested within the sleeve. Such light-emitting diodes extend along a longitudinal length of the sleeve and are selectively illuminable so that the player can advantageously readily identify illuminated ones of the light-emitting diodes during playing conditions. Each of the light-emitting diodes displays one of a red color or a green color during operating conditions wherein each light-emitting diode interchangeably displays the red and green colors.

A mechanism is included for automatically illuminating the light-emitting diodes in a predetermined sequence corresponding with a desired one of the chords, scales, and riffs so that the player can learn five separate six-string pentatonic patterns by using only one of the six strings to identify a desired key. Such an illuminating mechanism is directly coupled to the light-emitting diodes and detachably mounted directly to the guitar and adjacent to the guitar neck. The illuminating mechanism conveniently teaches the player to learn six-string progressions so that the player can play all essential chords in any key.

Such an illuminating mechanism includes a control switch that extends outwardly from the housing and resets the light-emitting diodes when the player activates the control switch. A transformer is electrically mateable to the illuminating mechanism for converting a 110-volt power supply to a 4.5-volt power supply. The light-emitting diodes provide a visual pattern for conveniently teaching the player where to position his or her fingers on the guitar neck when performing the desired one of the chords, scales and riffs.

The illuminating mechanism preferably includes a housing and a circuit board positioned within the housing. Such a circuit board includes a counter circuit and a trigger circuit directly and electrically coupled thereto wherein the counter circuit generates and transmits a reset input signal to the trigger circuit. The trigger circuit generates and transmits an output signal corresponding to characteristics of the input reset signal. A 4-bit binary counter circuit is directly and electrically coupled to the trigger circuit and effectively cooperates therewith for selectively illuminating the light-emitting diodes based upon the desired one of the chords, scales, and riffs selected by the player.

The illuminating mechanism preferably further includes a plurality of electrically coupled EPROM cards including software instructions for enabling the device to identify a sequence of patterns identifying finger positions along the guitar neck when the desired one of the chords, scales and riffs is selected by the player.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
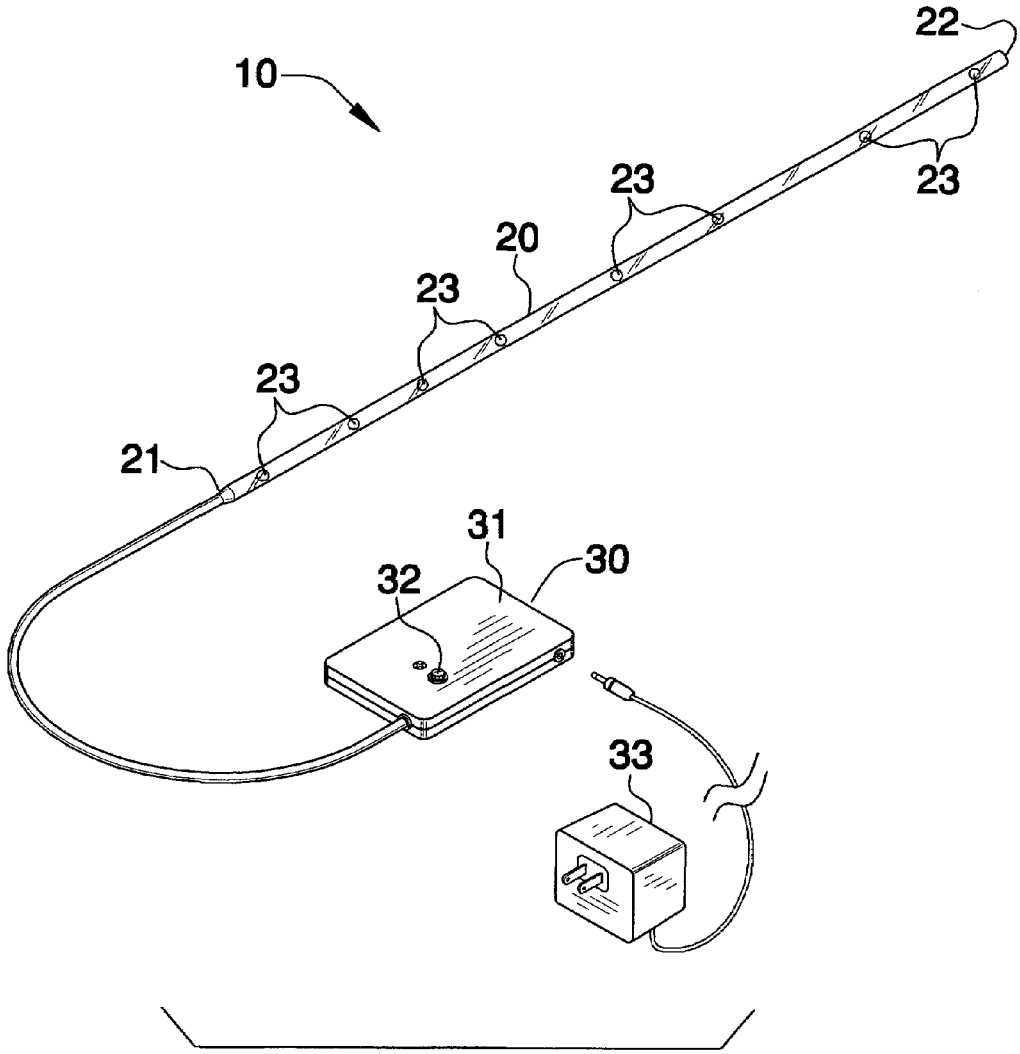
FIG. 1 is a perspective view showing an electronic guitar training device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–5 by the reference numeral 10 and is intended to provide an electronic guitar training device. It should be understood that the device 10 may be used to train on many different types of guitars and should not be limited in use to only training on electronic guitars.

Referring initially to FIG. 1, the device 10 includes an elongated and tubular sleeve 20 formed from transparent material that is removably mounted to the guitar neck 12 in such a manner that the player can effectively maintain a continuous line of sight with the sleeve 20 and the guitar neck 12 during playing conditions. Of course, the sleeve 20 may be produced in a variety of different lengths and, in such a manner that the device 10 may be adapted to various guitar body styles, as is obvious to a person of ordinary skill in the art. Such a sleeve 20 extends along an entire longitudinal length of the guitar neck 12, so as to effectively indicate the entire range of possible chords and riffs that can be played. The sleeve 20 is rectilinear and has an open end portion 21 and an axially offset closed end portion 22.

Figure 2:
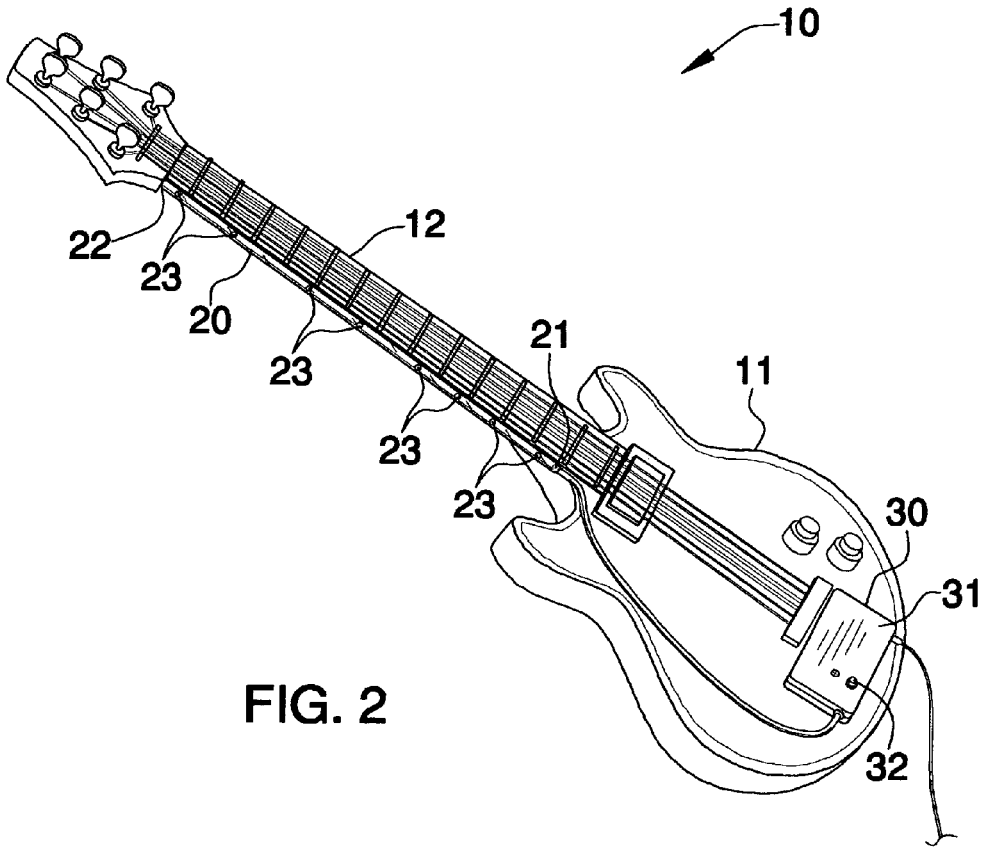
FIG. 2 is a perspective view of the device shown in FIG. 1, showing the electronic guitar training device attached to an electronic guitar.
Figure 3:
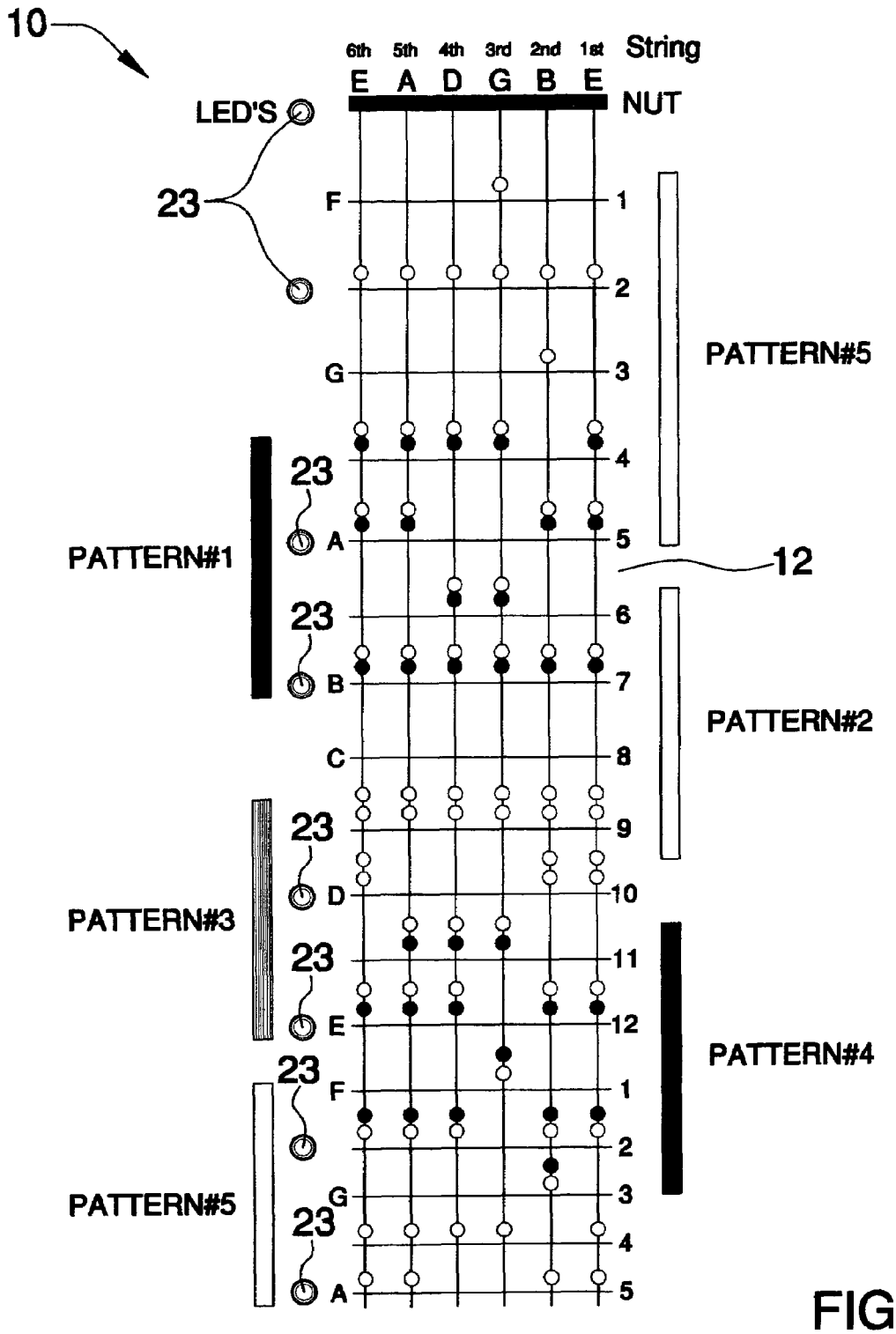
FIG. 3 is a top plan view of the guitar neck shown in FIG. 2, showing the LED locations in relation thereto.

Referring to FIGS. 1 through 3, a plurality of light-emitting diodes 23 are connected in series and nested within the sleeve 20. Such light-emitting diodes 23 extend along a longitudinal length of the sleeve 20 and are selectively illuminable, which is critical to playing the guitar because the player can advantageously readily identify illuminated ones of the light-emitting diodes 23 during playing conditions. Conveniently, the illuminable light emitting diodes 23 are easily visualized, even under poor lighting conditions, thus advantageously allowing a user to practice their guitar playing skill virtually anywhere, and at any time.

Each of the light-emitting diodes 23 displays one of a red color or a green color during operating conditions wherein each light-emitting diode 23 interchangeably displays the red and green colors. Of course, such light emitting diodes 23 may display colors, other than red and green, as is obvious to a person of ordinary skill in the art. The concept of placing one's fingers at the appropriately lit diodes 23 is easy to comprehend and follow, thus allowing the device 10 to be used by persons of all ages, even those too young or unable to read properly.

Referring to FIGS. 1 and 2, a mechanism 30 is included for automatically illuminating the light-emitting diodes 23 in a predetermined sequence corresponding with a desired one of the chords, scales, and riffs so that the player can learn five separate six-string pentatonic patterns by using only one of the six strings to identify a desired key. Such an illuminating mechanism 30 is directly coupled to the light-emitting diodes 23 and detachably mounted directly to the guitar 11 and adjacent to the guitar neck 12. The illuminating mechanism 30 conveniently teaches the player to learn six-string progressions so that the player can play all essential chords in any key.

Still referring to FIGS. 1 and 2, such an illuminating mechanism 30 includes a control switch 32 that extends outwardly from the housing 31 (described herein below) and resets the light-emitting diodes 23 when the player activates the control switch 32. A transformer 33 is electrically mateable to the illuminating mechanism, which is essential for conveniently converting a 110-volt power supply to a 4.5-volt power supply. The light-emitting diodes 23 provide a visual pattern that is critical for conveniently teaching the player where to position his or her fingers on the guitar neck 12 when performing the desired one of the chords, scales, and riffs.

Referring to FIGS. 1, 2, 4 and 5, the illuminating mechanism also includes a housing 31 and a circuit board 34 positioned within the housing 31. Such a circuit board 34 includes a counter circuit 35 and a trigger circuit 36 directly and electrically coupled thereto with no intervening elements wherein the counter circuit 35 is essential for generating and transmitting a reset input signal to the trigger circuit 36. The trigger circuit 36 generates and transmits an output signal corresponding to characteristics of the input reset signal. A 4-bit binary counter circuit 37 is directly and electrically coupled with no intervening elements to the trigger circuit 36 and effectively cooperates therewith for selectively illuminating the light-emitting diodes 23 based upon the desired one of the chords, scales, and riffs selected by the player.

Figure 4:
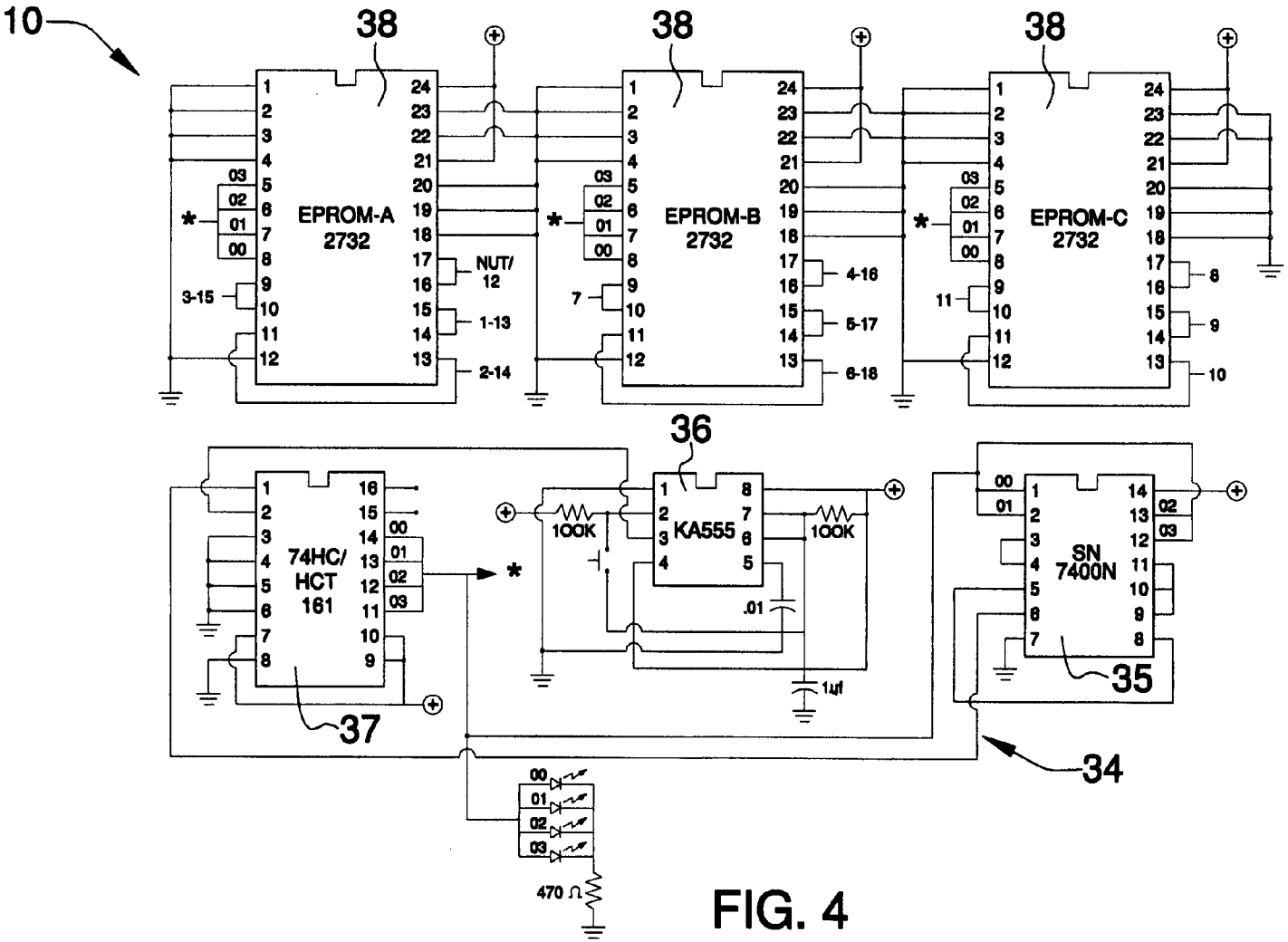
FIG. 4 is a front schematic diagram of the circuit board, showing the EPROM cards as well as the 4-Bit Binary Counter, the trigger, and the reset counter.
Figure 5:
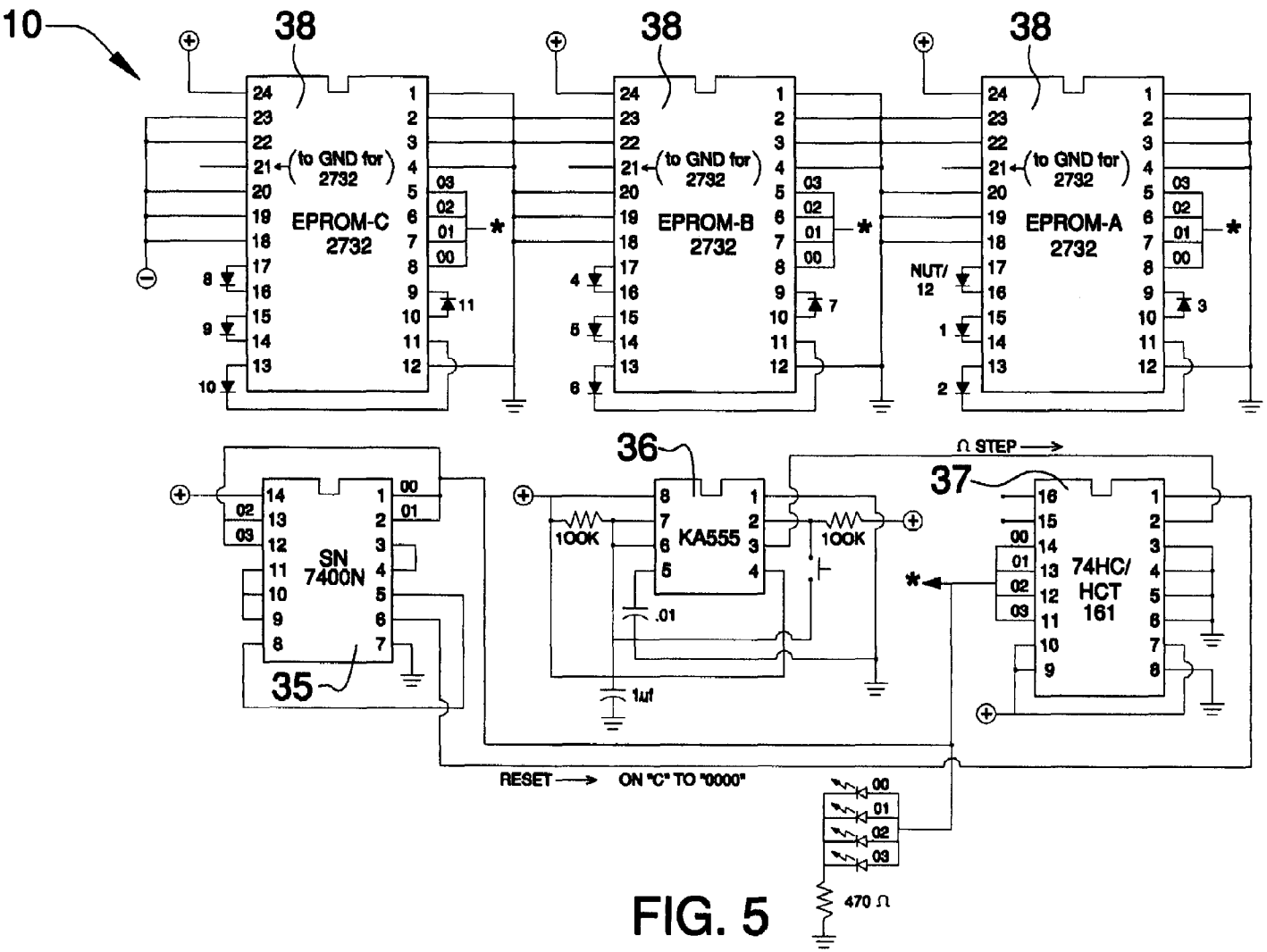
FIG. 5 is a schematic diagram of the rear of the circuit board shown in FIG. 4.

Referring to FIGS. 4 and 5, the illuminating mechanism 30 further includes a plurality of electrically coupled EPROM cards 38 including software instructions that are vital for enabling the device 10 to identify a sequence of patterns identifying finger positions along the guitar neck 12 when the desired one of the chords, scales, and riffs is selected by the player.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A training device for assisting a novice guitar player to quickly and readily identify finger positions on a six-string guitar neck which are associated with selected chords, scales and riffs, said training device comprising:

an elongated and tubular sleeve formed from transparent material and removably mounted to the guitar neck in such a manner that the player can maintain a continuous line of sight with said sleeve and the guitar neck during playing conditions, said sleeve extending along an entire longitudinal length of the guitar neck;

a plurality of light-emitting diodes connected in series and nested within said sleeve, said light-emitting diodes extending along a longitudinal length of said sleeve and being selectively illuminable so that the player can readily identify illuminated ones of said light-emitting diodes during playing conditions, each said light-emitting diodes displaying one of a red color and a green color during operating conditions wherein each said light-emitting diode interchangeably displays the red and green colors;

means for automatically illuminating said light-emitting diodes in a predetermined sequence corresponding with a desired one of the chords, scales and riffs so that the player can learn five separate six-string pentatonic patterns by using only one of the six strings to identify a desired key, said illuminating means being directly coupled to said light-emitting diodes and detachably mounted directly to the guitar and adjacent to the guitar neck, said illuminating means teaching the player to learn six-string progressions so that the player can play all essential chords in any key; and a transformer electrically mateable to said illuminating means for converting a 110-volt power supply to a 4.5-volt power supply:

wherein said light-emitting diodes provide a visual pattern for teaching the player where to position his or her fingers on the guitar neck when performing said desired one of the chords, scales and riffs.

2. The training device of claim 1, wherein said illuminating means comprises:

a housing;

a circuit board positioned within said housing, said circuit board including a counter circuit and a trigger circuit directly and electrically coupled thereto wherein said counter circuit generates and transmits a reset input signal to said trigger circuit, said trigger circuit generating and transmitting an output signal corresponding to characteristics of said input reset signal; and a 4-bit binary counter circuit directly and electrically coupled to said trigger circuit and cooperating therewith for selectively illuminating said light-emitting diodes based upon said desired one of the chords, scales and rifts selected by the player.

3. The training device of claim 2, wherein said illuminating means further comprises:

a plurality of electrically coupled EPROM cards including software instructions for enabling said device to identify a sequence of patterns identifying finger positions along the guitar neck when said desired one of the chords, scales and rifts is selected by the player.

4. A training device for assisting a novice guitar player to quickly and readily identify finger positions on a six-string guitar neck which are associated with selected chords, scales and riffs, said training device comprising:

an elongated and tubular sleeve formed from transparent material and removably mounted to the guitar neck in such a manner that the player can maintain a continuous line of sight with said sleeve and the guitar neck during playing conditions, said sleeve extending along an entire longitudinal length of the guitar neck;

a plurality of light-emitting diodes connected in series and nested within said sleeve, said light-emitting diodes extending along a longitudinal length of said sleeve and being selectively illuminable so that the player can readily identify illuminated ones of said light-emitting diodes during playing conditions, each said light-emitting diodes displaying one of a red color and a green color during operating conditions wherein each said light-emitting diode interchangeably displays the red and green colors;

means for automatically illuminating said light-emitting diodes in a predetermined sequence corresponding with a desired one of the chords, scales and rifts so that the player can learn five separate six-string pentatonic patterns by using only one of the six strings to identify a desired key, said illuminating means being directly coupled to said light-emitting diodes and detachably mounted directly to the guitar and adjacent to the guitar neck, said illuminating means teaching the player to learn six-string progressions so that the player can play all essential chords in any key;

wherein said illuminating means comprises: a control switch extending outwardly from said housing and resetting said light-emitting diodes when the player activates said control switch; and a transformer electrically mateable to said illuminating means for converting a 110-volt power supply to a 4.5 volt power supply;

wherein said light-emitting diodes provide a visual pattern for teaching the player where to position his or her fingers on the guitar neck when performing said desired one of the chords, scales and rifts.

5. The training device of claim 4, wherein said illuminating means comprises:

a housing;

a circuit board positioned within said housing, said circuit board including a counter circuit and a trigger circuit directly and electrically coupled thereto wherein said counter circuit generates and transmits a reset input signal to said trigger circuit, said trigger circuit generating and transmitting an output signal corresponding to characteristics of said input reset signal; and a 4-bit binary counter circuit directly and electrically coupled to said trigger circuit and cooperating therewith for selectively illuminating said light-emitting diodes based upon said desired one of the chords, scales and riffs selected by the player.

6. The training device of claim 5, wherein said illuminating means further comprises:

a plurality of electrically coupled EPROM cards including software instructions for enabling said device to identify a sequence of patterns identifying finger positions along the guitar neck when said desired one of the chords, scales and riffs is selected by the player.

7. A training device for assisting a novice guitar player to quickly and readily identify finger positions on a six-string guitar neck which are associated with selected chords, scales and riffs, said training device comprising:

an elongated and tubular sleeve formed from transparent material and removably mounted to the guitar neck in such a manner that the player can maintain a continuous line of sight with said sleeve and the guitar neck during playing conditions, said sleeve extending along an entire longitudinal length of the guitar neck, said tubular sleeve being positioned along a longitudinal edge of the guitar neck in such a manner that the guitar neck strings remain uncovered and exposed for allowing the player to directly engage the guitar neck strings during playing conditions;

wherein said sleeve is rectilinear and has an open end portion and an axially offset closed end portion, said closed end portion being disposed at a distal end of the guitar neck;

a plurality of light-emitting diodes connected in series and nested within said sleeve, said light-emitting diodes extending along a longitudinal length of said sleeve and being selectively illuminable so that the player can readily identify illuminated ones of said light-emitting diodes during playing conditions, each said light-emitting diodes displaying one of a red color and a green color during operating conditions wherein each said light-emitting diode interchangeably displays the red and green colors, said light-emitting diodes being spaced away from the guitar neck strings and extending along the longitudinal edge of the guitar neck without covering any part of the guitar neck strings;

means for automatically illuminating said light emitting diodes in a predetermined sequence corresponding with a desired one of the chords, scales and riffs so that the player can learn five separate six-string pentatonic patterns by using only one of the six strings to identify a desired key, said illuminating means being directly coupled to said light-emitting diodes and detachably mounted directly to the guitar and adjacent to the guitar neck, said illuminating means teaching the player to learn six-string progressions so that the player can play all essential chords in any key;

wherein said illuminating means comprises: a control switch extending outwardly from said housing and resetting said light-emitting diodes when the player activates said control switch; and a transformer electrically mateable to said illuminating means for converting a 110-volt power supply to a 4.5-volt power supply;

wherein said light-emitting diodes provide a visual pattern for teaching the player where to position his or her fingers on the guitar neck when performing said desired one of the chords, scales and riffs.

8. The training device of claim 7, wherein said illuminating means comprises:

a housing;

a circuit board positioned within said housing, said circuit board including a counter circuit and a trigger circuit directly and electrically coupled thereto wherein said counter circuit generates and transmits a reset input signal to said trigger circuit, said trigger circuit generating and transmitting an output signal corresponding to characteristics of said input reset signal; and a 4-bit binary counter circuit directly and electrically coupled to said trigger circuit and cooperating therewith for selectively illuminating said light-emitting diodes based upon said desired one of the chords, scales and riffs selected by the player.

9. The training device of claim 8, wherein said illuminating means further comprises:

a plurality of electrically coupled EPROM cards including software instructions for enabling said device to identify a sequence of patterns identifying finger positions along the guitar neck when said desired one of the chords, scales and riffs is selected by the player.

* * * * *